US006204449B1

(12) United States Patent
Putorti et al.

(10) Patent No.: US 6,204,449 B1
(45) Date of Patent: Mar. 20, 2001

(54) PROJECTIONS ON FACE ELECTRICAL RECEPTACLE FOR PREVENTING INADVERTENT TRIPPING OF TEST SWITCH BY OVERSIZED ELECTRICAL PLUG

(75) Inventors: John J. Putorti, Seymour; Carol A. Howard, Oxford; Christopher J. Clark, Stratford, all of CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/291,544

(22) Filed: Apr. 14, 1999

(51) Int. Cl.[7] ..... H01H 9/02
(52) U.S. Cl. ..... 174/53; 439/107; 439/617
(58) Field of Search ..... 174/53, 58; 439/617, 439/214, 107; 200/43.18

(56) References Cited

U.S. PATENT DOCUMENTS 2,813,938 * 11/1957 Speizman ..... 200/43.21
3,723,948 * 3/1973 Wyatt et al. ..... 439/107
3,900,238 * 8/1975 Anderson ..... 439/107
4,363,944 * 12/1982 Poirier ..... 200/43.19
4,668,034 * 5/1987 McHattie et al. ..... 439/107
5,161,240 * 11/1992 Johnson ..... 361/42
5,266,039 * 11/1993 Boyer et al. ..... 439/107
5,484,309 * 1/1996 Howard et al. ..... 439/539
5,708,554 * 1/1998 Liner ..... 361/104

* cited by examiner

*Primary Examiner*—Kristine Kincaid
*Assistant Examiner*—Dhiru R. Patel
(74) *Attorney, Agent, or Firm*—Michael R. Swartz

(57) ABSTRACT

An electrical receptacle includes a receptacle body, test and reset switches and a pair of projections. The body has electrical elements disposed therein for making electrical contact with an electrical plug of various diameter sizes. The body has a face with a set of apertures for receiving prongs of the electrical plug for mating of the plug with the receptacle. The switches are mounted to the face of the body adjacent to the set of apertures and are actuatable to affect operation of the electrical elements. The projections are made of a substantially rigid material and mounted to the face of the body adjacent to the test switch and the set of apertures and protrude from the body. The projections extend outwardly from the face of the body adjacent to the test switch such that upon mating with the receptacle a plug having an oversized diameter will engage the projections and thereby be prevented from making contact with the test switch sufficient to cause tripping thereof and thereby avoid inadvertent actuation of the test switch. The height of the projections is at least as great as the height of the test switch. The projections are located adjacent to opposite ends of the test switch.

3 Claims, 2 Drawing Sheets

PROJECTIONS ON FACE ELECTRICAL RECEPTACLE FOR PREVENTING INADVERTENT TRIPPING OF TEST SWITCH BY OVERSIZED ELECTRICAL PLUG

BACKGROUND OF THE INVENTION

1. Field of the Invention

The present invention generally relates to electrical receptacle assemblies and, more particularly, is concerned with projections on a face of an electrical receptacle for preventing inadvertent tripping of a test switch by an oversized electrical plug.

2. Description of the Prior Art

Heretofore, electrical receptacles manufactured and marketed by Hubbell Incorporated of Orange, Conn., the assignee of the subject application, and commonly known as ground fault receptacles, have employed both test and reset switches on a face or front cover of the electrical receptacle. Electrical plugs with plug bodies having different diameter sizes can be used with most electrical receptacles. The bodies of some of these plugs have diameters which are oversized relative to the dimensions of the mating surface portions of the front face of the electrical receptacle containing holes where the prongs of the plugs are inserted into electrical contacts of the receptacle. Due to their oversized diameters, the bodies of these oversized plugs have peripheral edges which extend beyond the mating surface portions of the receptacle.

A problem exists in that, with the action of inserting and mating the oversized plug with the electrical receptacle, a portion of the peripheral edge of the body of the oversized plug may contact one or both of the test and reset switches and cause inadvertent tripping thereof. A satisfactory solution to this problem does not appear to exist in the prior art.

Consequently, a need remains for an innovation which will provide an effective solution to the aforementioned problem in the prior art without introducing any new problems in place thereof.

SUMMARY OF THE INVENTION

The present invention provides an electrical receptacle designed to satisfy the aforementioned need. The electrical receptacle of the present invention incorporates at least one and preferably a pair of projections on a face thereof which protrude outwardly from the face for preventing inadvertent engagement with and tripping of either a test switch or reset switch by a peripheral edge portion of a body of an oversized electrical plug. The projections on the receptacle are preferably disposed adjacent to opposite ends of one or both of the switches and extend to a height outwardly from the receptacle face at least the same as a height of the test switch or reset switch therefrom. Thus, upon mating with the receptacle, an oversized electrical plug will engage the projections and thereby be prevented from making contact with either of the switches sufficient to cause tripping of the same. The projections also have sufficient structural rigidity to stop movement of the oversized electrical plug toward the switches that would otherwise produce tripping contact with the one or both switches.

Accordingly, the present invention is directed to an electrical receptacle which comprises: (a) a receptacle body having electrical elements disposed therein for making electrical contact with an electrical plug of various diameter sizes, the receptacle body having a face with at least one set of apertures formed therein for receiving prongs of the plug for mating of the plug with the receptacle; (b) at least one switch mounted to the face of the receptacle body adjacent to the one set of apertures and being actuatable to affect operation of the electrical elements in the receptacle body; and (c) at least one projection made of a substantially rigid material and mounted to the face of the receptacle body adjacent to the one switch and one set of apertures and protruding therefrom, the one projection extending outwardly from the face of the receptacle body such that upon mating with the receptacle an electrical plug having an oversized diameter will engage the one projection and thereby be prevented from making contact with the one switch sufficient to cause tripping thereof and thereby avoid inadvertent actuation of the one switch.

More particularly, the at least one switch with which the projections are associated can be either a test switch and/or a reset switch. The at least one set of apertures in the receptacle body includes two sets of apertures each for receiving prongs of a respective one electrical plug. The test switch is disposed closer to one of the sets of apertures of the body and the reset switch is disposed closer to the other of the sets of apertures. Preferably, at least one pair of projections is provided. Each projection is positioned adjacent to one of a pair of opposite ends of the respective switch.

Also, the switch and the projections extend to respective heights from the face of the receptacle body where the height of the projections is at least as great as, and preferably greater than, the height of the switch. The switch and the projections have respective sizes where the size of the switch is greater than the size of the projections.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
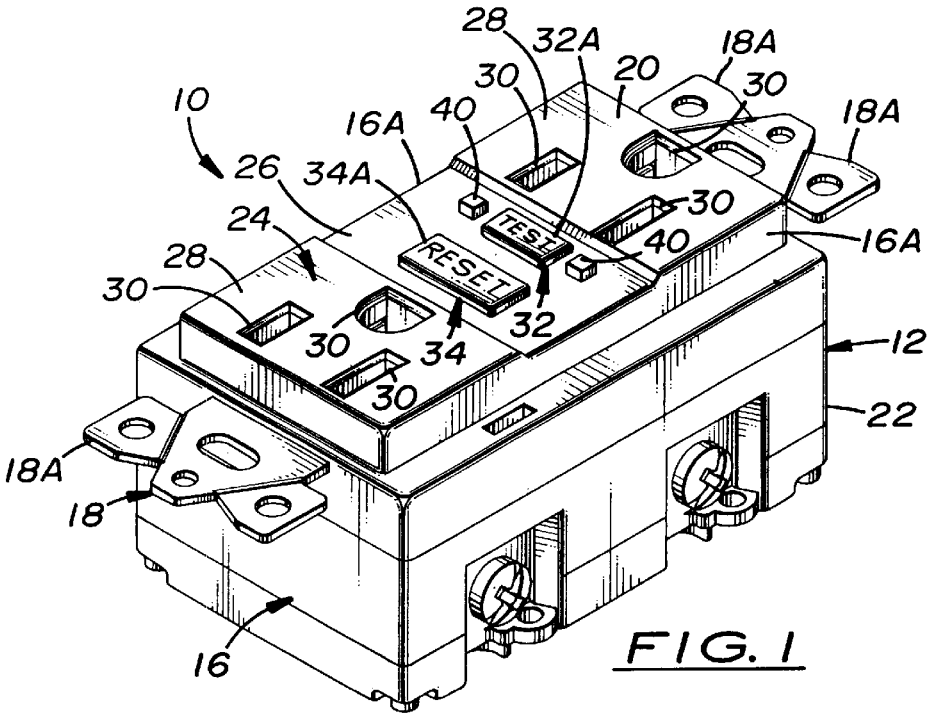
FIG. 1 is a perspective view of an electrical receptacle of the present invention showing a pair of projections positioned adjacent to opposite ends of a switch of the receptacle.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Figure 2:
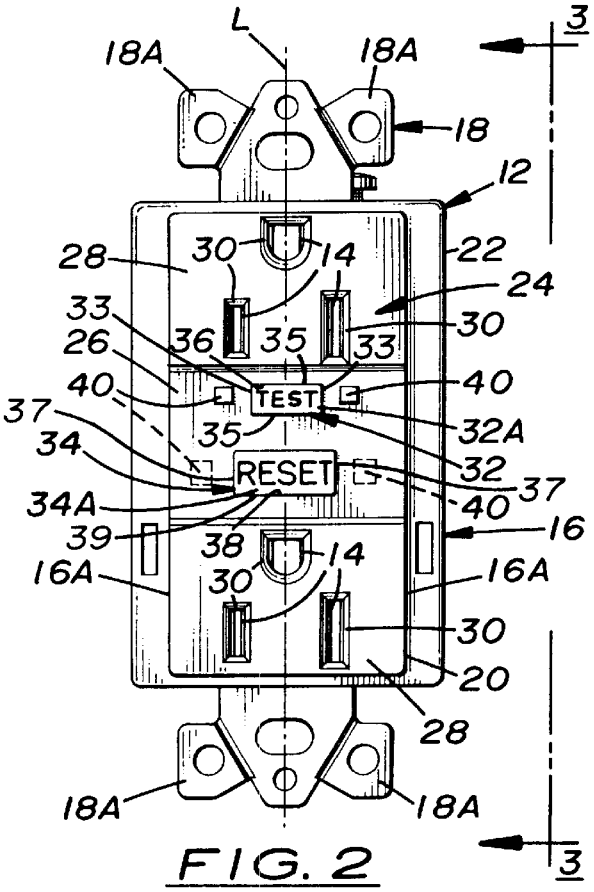
FIG. 2 is a front plan view of the electrical receptacle of FIG. 1 showing the pair of projections, in solid line form, adjacent to opposite ends of the one switch, labeled "Test" and another pair of projections, in dashed line form, adjacent to opposite ends of the other switch, labeled "Reset".
Figure 3:
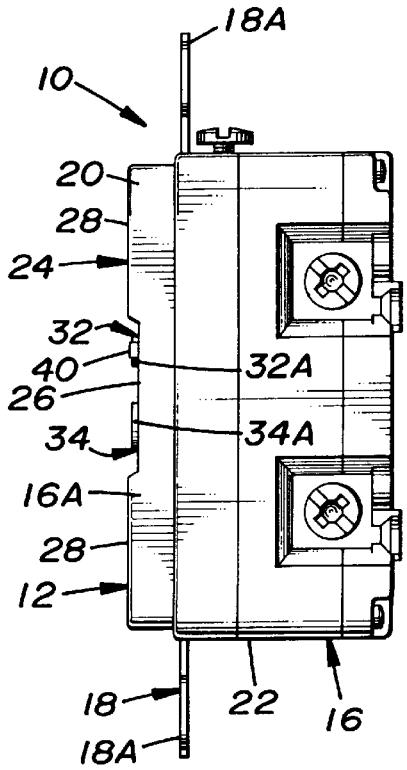
FIG. 3 is a side elevational view of the electrical receptacle as seen along line 3—3 of FIG. 2.
Figure 4:
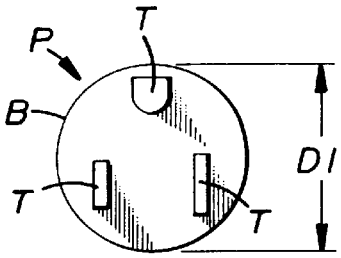
FIG. 4 is an end view of an electrical plug having a normal-sized diameter.
Figure 5:
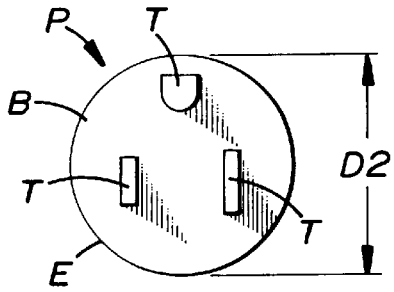
FIG. 5 is an end view of an electrical plug having an oversized diameter.

Referring to the drawings and particularly to FIGS. 1 to 3, there is illustrated an electrical receptacle, generally designated 10, of the present invention. The electrical receptacle 10 includes a receptacle body 12 having electrical elements 14 disposed therein for making electrical contact with terminal blades or prongs T of conventional electrical plugs P of various diameter sizes, such as seen in FIGS. 4 and 5. Such electrical elements 14 are electrical contacts and the like which are well-known and need not be described in detail herein. The receptacle body 12 generally includes a housing 16 and a mounting bridge 18 having ears 18A. The housing 16 substantially encloses the aforementioned electrical elements 14 in the receptacle body 12. The housing 16 has a two-piece construction formed by a front cover 20 and a back cover 22. The back cover 22 is separate from and mateable with the front cover 20. When the front and back covers 20, 22 are disposed in a mated relationship with one another, they sandwich and capture the mounting bridge 18 therebetween and fasteners (not shown), such as screws, are then employed to retain the housing 16 in the assembled condition. The ears 18A at opposite ends of the mounting bridge 18 are employed for attachment of the assembled receptacle 10 to any suitable structure, such as a building wall, by the use of fasteners (not shown), such as screws.

The front cover 20 of the housing 16 of the receptacle body 12 has a front face 24 with a middle portion 26 and opposite end portions 28. The opposite end portions 28 extend from opposite ends of the middle portion 26. Each of the opposite end portions 28 are substantially identical to one another and larger in area than the middle portion 26. Each of the middle portion 26 and opposite end portions 28 of the front face 24 has a substantially rectangular configuration. Each opposite end portion 28 of the front face 24 is raised or located at a height H1 from the middle portion 26 of the front face 24.

The front cover 20 of the receptacle body 12 also has at least one and, preferably, two sets of apertures 30 formed therein which lead to and partially expose the electrical elements 14. More particularly, each set of apertures 30 is defined in one of the opposite end portions 28 of the front face 24 of the front cover 20. Each set of apertures 30 receives the prongs T of a respective one electrical plug P. Each electrical plug P typically has three prongs T and a plug body B. Each set of apertures 30 typically has three apertures 30 which have configurations and spacings matching those of the three prongs T of the plug P. When the prongs T of a plug P are inserted completely into the apertures 30 in one opposite end portion 28 of the front face 24, the plug body B generally makes flush contact with the front face 24. The plug body B may have any of a variety of diameters, such as a normal-sized diameter D1, as shown in FIG. 4 and in solid line form in FIG. 6, or an oversized diameter D2, as shown in FIG. 5 and in broken line form in FIG. 6.

The electrical receptacle 10 preferably is a ground fault type receptacle and so includes in the receptacle body 12 at least one and preferably both of a test switch 32 and a reset switch 34 which are electrically coupled to the electrical elements 14 within the receptacle body 12. As shown in FIGS. 1 to 3 and 6, the portions of the respective test and reset switches 32, 34 that are exposed at the middle portion 26 of the front face 24 of the receptacle body 12 are in the form of pushbuttons 32A, 34A which extend outwardly through openings 36, 38 in the middle portion 26. The test and reset switches 32, 34 are actuated by their pushbuttons 32A, 34A being depressed to affect operation of the electrical elements 14 of the receptacle body 12. More particularly, the test switch 32 when actuated causes interruption or opening of the electrical circuit of which the electrical receptacle 10 is a part whereas the reset switch 32 when actuated causes resetting or closing of the electrical circuit. The test and reset switches 32, 34 are spaced apart from one another with the test switch 32 being located closer to one of the sets of apertures 30 of the body 12 and the reset switch 34 being located closer to the other of the sets of apertures 30 of the body 12. With reference to a longitudinal centerline L of the receptacle body 12 the test switch 32 is disposed centrally on the middle portion 26 of the front face 24 and is spaced from but disposed closer to one of the opposite end portions 28 thereof while the reset switch 34 is also disposed centrally on the middle portion 26 of the front face 24 and is spaced from but disposed closer to the other of the opposite end portions 28 thereof.

Each of the exposed pushbuttons 32A, 34A of the test and reset switches 32, 34 has a substantially polygonal, particularly rectangular, configuration, though need not be so limited and may have any other suitable configuration. The test switch 32 has opposite ends 33 and opposite sides 35 with one of the sides 35 being disposed adjacent the one set of apertures 30 on the one end portion 28 of the front cover 20, whereas, the reset switch 34 has opposite ends 37 and opposite sides 39 with one of the sides 39 being disposed adjacent the other set of apertures 30 on the opposite end portion 28 of the front cover 20. The pushbuttons 32A, 34A of the test and reset switches 32, 34 extend outwardly from the middle portion 26 of the front face 24 through substantially the same height H2 which is slightly less than the height H1 of the opposite end portions 28 of the front face 24 from the middle portion 26 thereof. The size of the reset switch pushbutton 34A is somewhat greater than the size of the test switch pushbutton 32A, though they need not be so limited. The electrical receptacle 10 described above is conventional per se and thus representative of the prior art.

Figure 7:
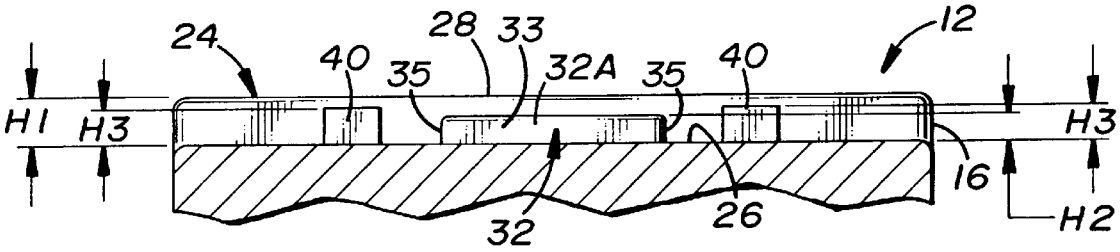
FIG. 7 is an enlarged fragmentary elevational view of the projections and switch of electrical receptacle as seen along line 7—7 of FIG. 6 showing the height of the projections relative to the height of the Test switch.
Figure 6:
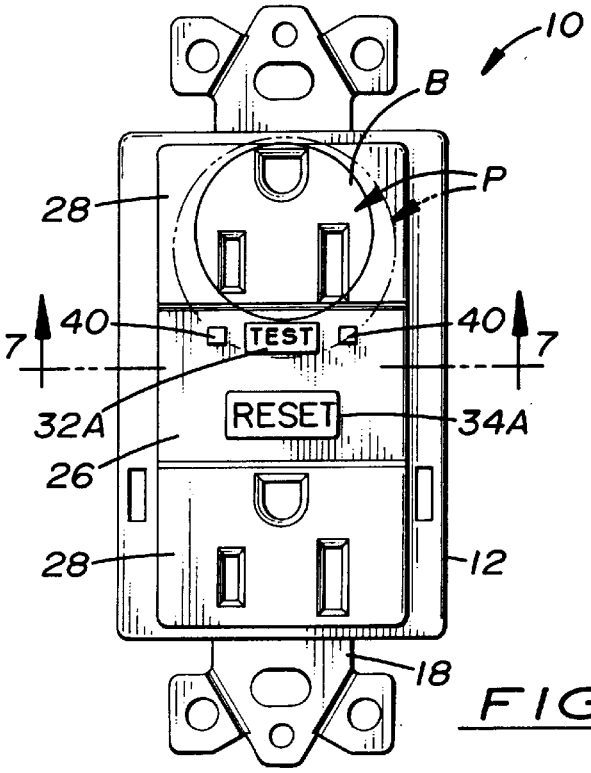
FIG. 6 is a front plan view of the electrical receptacle similar to that of FIG. 2 showing the normal-sized diameter of the electrical plug of FIG. 4 in solid line form and the oversized diameter of the electrical plug of FIG. 5 in broken line form.

Referring now to FIGS. 1 to 4, 6 and 7, the modification constituting the present invention which is made to the otherwise conventional electrical receptacle 10 is the provision of at least one and preferably a pair of protuberances or projections 40, being located adjacent to at least the test switch 32. The projections 40 protrude outwardly from the front face 24 through a height H3 at least as great as the height H2 of the test switch 32 outwardly from the front face 24 for preventing unwanted or inadvertent engagement with and actuating or tripping of the test switch 32 by a peripheral edge portion E of the plug body B of the oversized electrical plug P, as shown in FIGS. 5 to 7. When an oversized plug P is inserted and mated with the receptacle 10, the plug P tends to pivot downward and against the pushbutton 32A of the test switch 32. The test switch pushbutton 32A is pressed inwardly by this action, causing tripping of the test switch 32 and opening or interrupting of the electrical circuit. The circuit must then be reset by pressing inward on the reset switch pushbutton 34A.

Each projection 40 is comprised of a substantially rigid plastic material and is mounted to the middle portion 26 of the front face 24 of the receptacle body 12 somewhere adjacent to the test switch 32. Preferably, one of the pair of projections 40 is disposed adjacent to one end 33 of the test switch 32 and the other one of the pair of projections 40 is disposed adjacent to the opposite end 33 of the test switch 32. The peripheral edge portion E of the body B of an electrical plug P having an oversized diameter D2, such as shown in FIGS. 5 to 7, will now engage at least one and preferably both of the projections 40 upon insertion of the prongs T of the plug P into one of the sets of apertures 30 in the adjacent opposite end portion 28 of the front face 24 and thereby avoid pivoting of the plug P into the test switch pushbutton 32A and inadvertent actuation of the test switch 32. The projections 40 are formed and attached on the middle portion 26 of the front face 24 of the housing 16 preferably adjacent to opposite ends of the test switch pushbutton 32A, as seen in solid line form in FIG. 2. Likewise, as shown in dashed line form in FIG. 2, another pair of projections 40 can be provided on the middle portion 26 of the front face 24 of the housing 16 adjacent to opposite ends of the reset switch pushbutton 34A. The projections 40 are disposed closer to their respective switches 32, 34 than to respective opposite sides 16A of the housing 12. The projections 40 could be disposed at other suitable locations, if space should be available, such as between the respective switches 32, 34 and opposite end portions 28 of the front face 24 of the housing 16.

Each projection 40 has a substantially solid block-like configuration and a substantially polygonal, particularly square or rectangular, configuration when viewed from above, though need not be so limited and may have any other suitable configuration. The height H3 of each projection 40 is substantially the same and preferably is slightly greater than the height H2 of the associated one of the switches 32, 34. Furthermore, each projection 40 has a size which is substantially the same as one another, though need not be so limited. The size of each of the pushbuttons 32A, 34A of the test and reset switches 32, 34 is greater than the size of each projection 40, though need not be so limited.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An electrical receptacle, comprising:

(a) a receptacle body having electrical elements disposed therein for making electrical contact with an electrical plug of various diameter sizes and electrical contacts disposed therein for operation between open and closed conditions, said receptacle body having a face with at least one set of apertures formed therein for receiving prongs of the plug for mating of the plug with the receptacle;

(b) at least one switch having opposite ends and one side extending between said opposite ends, said at least one switch being mounted to said face of said receptacle body such that said one side is disposed adjacent to said one set of apertures and being actuatable to affect operation of said electrical contacts between said open and closed conditions; and (c) a pair of projections each made of a substantially rigid material and mounted to said face of said receptacle body adjacent to one of said opposite ends of said at least one switch and protruding therefrom, said pair of projections extending outwardly and having heights from said face of said receptacle body greater than that of said at least one switch such that when said electrical plug having an oversized diameter is mated with said receptacle said electrical plug will engage and be supported at least at two locations by said pair of projections and thereby be prevented from making contact with said at least one switch sufficient to cause tripping thereof and thereby avoid inadvertent actuation of said at least one switch.

2. The receptacle as recited in claim 1, wherein each one of said pair of projections has a block-like configuration.

3. The receptacle as recited in claim 1, wherein each one of said pair of projections has a polygonal configuration when viewed from above.

* * * * *